US011205409B2

(12) United States Patent
Bognár et al.

(10) Patent No.: US 11,205,409 B2
(45) Date of Patent: Dec. 21, 2021

(54) PROGRAMMABLE SIGNAL PROCESSING AND MUSICAL INSTRUMENT SETUP SYSTEM FOR STRINGED MUSICAL INSTRUMENTS, AND METHOD FOR PROGRAMMING AND OPERATING THE SYSTEM

(71) Applicants: András Bognár, Dunaharaszti (HU); Dániel Bognár, Dunaharaszti (HU); Sándor Bognár, Dunaharaszti (HU)

(72) Inventors: András Bognár, Dunaharaszti (HU); Dániel Bognár, Dunaharaszti (HU); Sándor Bognár, Dunaharaszti (HU)

( * ) Notice: Subject to any disclaimer, the term of this patent is extended or adjusted under 35 U.S.C. 154(b) by 0 days.

(21) Appl. No.: 16/649,638

(22) PCT Filed: Sep. 27, 2018

(86) PCT No.: PCT/HU2018/000040
§ 371 (c)(1),
(2) Date: Mar. 21, 2020

(87) PCT Pub. No.: WO2019/064035
PCT Pub. Date: Apr. 4, 2019

(65) Prior Publication Data

US 2020/0320968 A1 Oct. 8, 2020

(30) Foreign Application Priority Data

Sep. 29, 2017 (HU) ..... P1700403

(51) Int. Cl.
*G10H 3/18* (2006.01)
*G10H 1/18* (2006.01)
*G10H 1/46* (2006.01)

(52) U.S. Cl.
CPC ..... *G10H 3/186* (2013.01); *G10H 1/18* (2013.01); *G10H 1/46* (2013.01);
(Continued)

(58) Field of Classification Search
CPC ..... G10H 3/186; G10H 1/18; G10H 1/46; G10H 2240/115; G10H 2220/106; G10H 2220/461
See application file for complete search history.

(56) References Cited

U.S. PATENT DOCUMENTS 4,913,024 A * 4/1990 Carriveau ..... G10H 3/182 84/726
5,866,834 A 2/1999 Burke et al.
(Continued)

FOREIGN PATENT DOCUMENTS

EP 2787501 A1 10/2014

OTHER PUBLICATIONS

Machine English translation of EP2787501A1.

*Primary Examiner* — Jeffrey Donels
(74) *Attorney, Agent, or Firm* — Ladas & Parry LLP

(57) ABSTRACT

A programmable signal processing and musical instrument setup system for stringed musical instruments, comprising at least one analog signal processing circuit, a control circuit operably coupled to at least one analog signal processing circuit, and a storage unit operably coupled to the control circuit, being arranged on the musical instrument for storing setup parameters for the musical instrument. The system comprises: a communication module with an individual identification information connected to the control circuit for enabling communication with an external programming device that has a storage unit configured for storing an individual identification information of at least one musical instrument, in association with the musical instrument in at least one configuration file. The external programming device is further configured for receiving and sending data to and from a selected musical instrument, when connected, wherein the data transferred to the musical instrument can be
(Continued)

Figure 1:
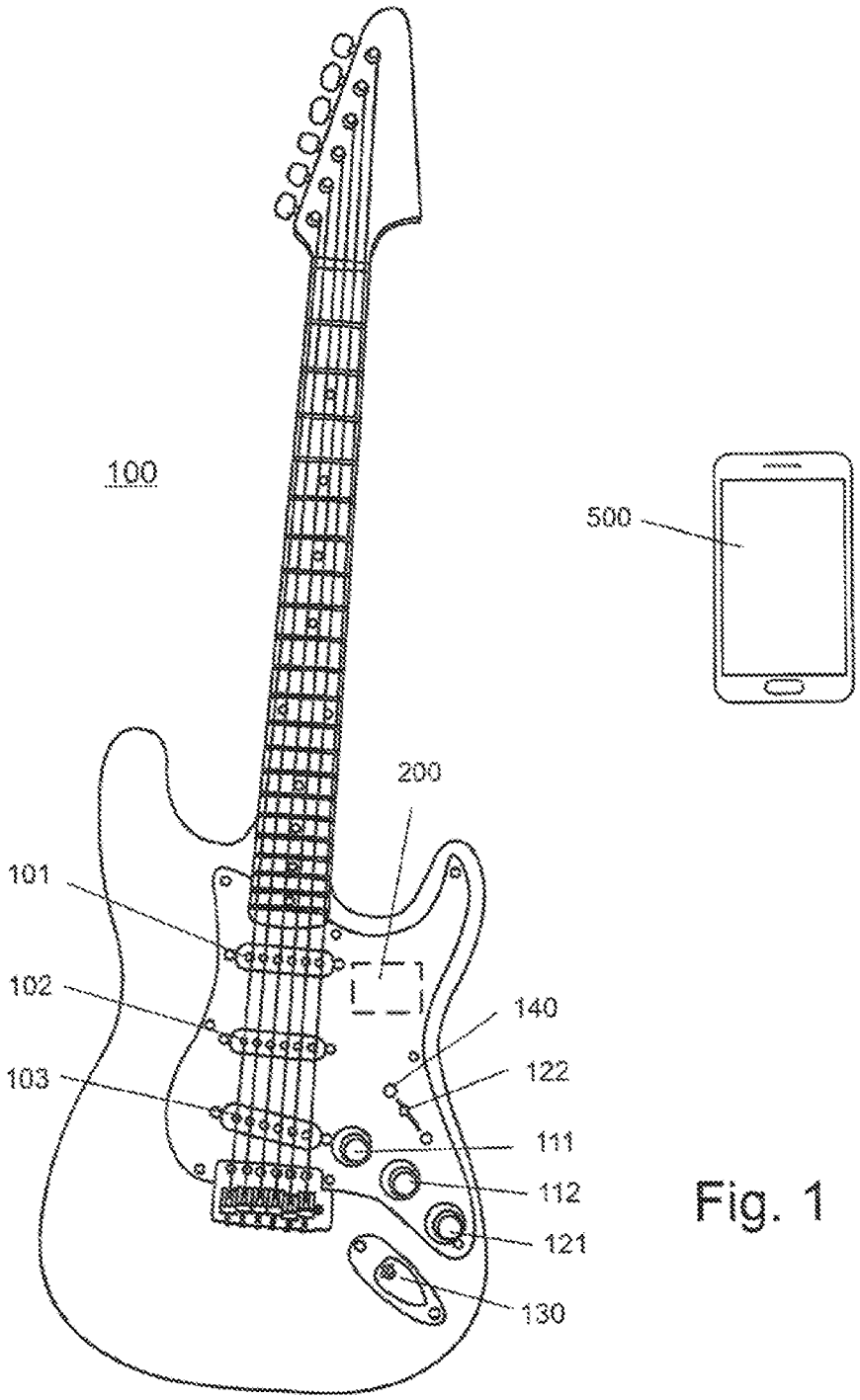

stored in the musical instrument and can be used after the external programming device is disconnected.

24 Claims, 12 Drawing Sheets

(52) U.S. Cl.
CPC . *G10H 2220/106* (2013.01); *G10H 2220/461* (2013.01); *G10H 2240/115* (2013.01)

(56) References Cited

U.S. PATENT DOCUMENTS 6,740,803 B2 * 5/2004 Brinkman ..... G06Q 20/00 84/609
7,030,311 B2 * 4/2006 Brinkman ..... G06Q 20/00 709/203
7,115,810 B2 * 10/2006 Ambrosino ..... G10H 1/18 84/742
7,220,912 B2 * 5/2007 Juszkiewicz ..... G10H 1/0058 84/728
7,276,657 B2 * 10/2007 Bro ..... G10H 1/18 84/723
7,279,631 B2 * 10/2007 Celi ..... G10H 1/053 84/723
7,521,628 B2 * 4/2009 Armstrong-Muntner ..... G10H 3/182 84/723
7,799,986 B2 * 9/2010 Ryle ..... G10H 3/183 84/737
8,796,531 B2 * 8/2014 Ambrosino ..... G10H 3/06 84/723
9,640,162 B2 * 5/2017 Ball ..... G10H 1/46
9,865,239 B1 * 1/2018 White ..... G10H 1/0083
10,115,379 B1 * 10/2018 Juszkiewicz ..... G10H 1/0091
2003/0196542 A1 * 10/2003 Harrison, Jr. ..... G04G 9/06 84/737
2012/0024129 A1 2/2012 Ball et al.
2014/0260906 A1 * 9/2014 Welch ..... G10H 1/02 84/603
2015/0059561 A1 * 3/2015 Mejia ..... G10H 1/125 84/737
2016/0335997 A1 * 11/2016 White ..... G10H 1/0083
2019/0371287 A1 * 12/2019 Pezeshkian ..... G10H 3/186

* cited by examiner

PROGRAMMABLE SIGNAL PROCESSING AND MUSICAL INSTRUMENT SETUP SYSTEM FOR STRINGED MUSICAL INSTRUMENTS, AND METHOD FOR PROGRAMMING AND OPERATING THE SYSTEM

RELATED APPLICATION

This application is an application under 35 U.S.C. 371 of International Application No. PCT/HU2018/000040 filed on 27 Sep. 2018, which claims priority from HU Application P1700403 filed 29 Sep. 2017, the entire contents of which are incorporated herein by reference.

The invention relates to a programmable signal processing and musical instrument setup system for stringed musical instruments, which comprises at least one analog signal processing circuit, a control circuit operably coupled to at least one analog signal processing circuit and a storage unit operably coupled to the control circuit, being arranged on the musical instrument. The musical instrument also comprises electro acoustic transducers, which are operably coupled to the signal processing circuit through controllable switches, and also mounted on the musical instrument there are continuously and discretely changeable setup means operably coupled to the control circuit, where the storage unit operably coupled to the control circuit stores at least one set of instrument setup parameters.

Stringed musical instruments in connection with the invention can be bowed er plucked stringed instruments, especially guitars, violins, zithers, lyres etc. Considering guitars the invention can be related to both acoustic, electric and bass guitars.

BACKGROUND OF THE INVENTION

In recent time the sound of acoustic musical instruments is converted into an electric signal (except some classical pieces performed in concert halls), the electric signals are processed according to need, then amplified and reach the audience with the help of high performance speakers. Traditional acoustic musical instruments can be installed with electro acoustic transducers, e.g. electric pickups, therefore their sound can be easily converted into an electric signal. Genuine electric musical instruments don't have a resonant body, and without electric signal processing and amplification they are inaudible compared to traditional acoustic instruments. In the next section we will be focusing on electric stringed musical instruments, especially electric guitars, but the following statements in most of the cases apply to other stringed musical instruments as well.

Under the strings of the electric guitar there are pickups, most commonly electromagnetic pickups, which are generating an electric signal from string vibration. The number of pickups commonly varies from one to five. Pickups generally have either a single coil or a double coil (humbucker) design. In case of double coil humbucker pickups, it is possible to change the connection between individual coils. Beside electromagnetic pickups, there are piezoelectric and other types of pickups as well. Active pickups are pickups with a built-in preamplifier, whereas pickups without preamplification are called passive pickups. In contrary to that, this document uses the term active and passive in the context of signal processing, where a passive guitar has only passive (R, L, C) elements, and an active guitar has active amplifier means in the signal processing. Signal processing with active amplifiers can be either analog or digital. In case of digital signal processing, electric signals generated from pickups are digitalized, digitally processed, and then converted back to analog signal.

General expectations towards electric guitars are excellent sound quality, versatility and ease of use.

Main criteria for excellent sound quality at signal processing without delay and the processed signal should contain the whole acoustic spectrum (frequency range) of the sound generated by strings.

Guitars instilled with active and passive electronics have no perceived delay in their signal. Signal delay is a main quality factor in digital signal processing, as analog to digital (AD) conversion, digital signal processing and digital to analog (DA) conversion cannot happen in real time. Furthermore, sound quality is exceptionally dependent on the quality of AD and DA conversions (number of bits, sampling frequency). Better sound quality requires more bits and higher sampling frequency, resulting in more data to process, therefore higher data processing capability and higher energy consumption are needed. As energy consumption is limited by the capacity of the battery, higher sound quality can only be achieved with higher signal delay.

According to prior art, the use of digital signal processing resulted in highly compromised solutions. Compared to analog signal processing, digital sound quality is worse and the appearing signal delay rules out professional use. The main advantage of digital signal processing is the versatility of sounds that can be achieved, as there are endless possibilities for altering a digital signal. The only restricting factor is that additional digital processing operations demand more processing capability, which in practice immensely limits versatility.

The other factor of sound quality is signal spectrum.

The signal spectrum of a guitar means how well the output signal can contain the full frequency range generated by the strings. Electronic components in passive guitars form an RLC filter, where L is the inductance of the pickups, R is the resistance of the potentiometers and C is the capacitance of the capacitors. Signal spectrum is limited according to the specification of the RLC filter. If there are more than one pickup present in a passive guitar, the guitar's inductance (Le) is measured as a sum of the present individual pickup inductances (Lhn). $Le=Lh1+Lh2+ \ldots +Lhn$. That means that changes in the RLC filter changes the signal spectrum, which means for example that signal generated from two pickups are not equal to the sum of the individual signals. Changes in potentiometer resistance have a similar effect, for example volume change modifies the tone of the guitar.

Active guitars usually have a high input impedance, which means that pickups work in voltage generation mode and signal spectrum isn't altered. In contrary to passive guitars, a signal generated from two pickups will be equal to the sum of the individual signals, so each pickup will represent its signal spectrum in the output signal. Furthermore, changes in volume won't have any effects on the tone of the guitar. Signal spectrum in digital signal processing is determined by the quality of AD/DA and the quality of signal processing.

In the context of the invention, versatility means the variety of tones (musical styles) that can be produced with a single guitar. Guitar tone can be altered with switching pickups, mixing the signals of the selected pickups, equalizing the signal and using effects.

Using more than one pickup is useful because the physical location and the type (single coil, humbucker, piezo) of the pickups fundamentally changes the signal spectrum, signal to noise ratio and phase. In theory a guitar with 3 single coil pickups can produce 26 distinctly different tones as every pickup can be used in 3 different modes (off, in phase, out of phase). The complexity of pickup switching means, that in practice out of the 26 tones only 5 can be used with a conventional 3 pickup guitar.

Mixing pickup signals means to what extent does a selected pickup represent itself in the ongoing signal.

With equalization, signal spectrum can be altered according to needs. In passive guitars equalization happens in a very limited way, by changing the R element in the RLC filter. In practice it is only capable of cutting higher frequencies. With active guitars there is a possibility of active equalization, which means that the signal spectrum (tone) can be altered by filters having multiple cutoff frequencies. In practice 2 or 3 band equalization is prevalent. In case of digital guitars, equalization is determined by the specification of the digital signal processor.

Guitar tone can be further altered with effects. Effects are signal operations that change signal spectrum according to a predefined algorithm, (delay, amplitude and frequency modulation, distortion etc . . . ). In case of passive guitars there are no effects. In case of active guitars usually 1 or 2 analog effects can be used. In ease of digital guitars, possibilities for effects are determined by the specification of the digital signal processor.

Usability is determined by built-in controls, switches or external devices that are necessary for a guitarist to have easy access to different sounds, a clean and simple way to program a guitar (if possible) and an easy to use power supply.

Programming a guitar means that new tones can be created, the parameters of the tones can be stored, reloaded and added to a collection. A collection is a list of tones assigned to certain switch positions. The benefit of a collection is that the guitarist has easy and quick access to very different tones with the help of a single switch. Programming a guitar has huge benefits in functionality, although more controls (switches, potentiometers) are necessary to be mounted on the guitar. However to increase usability, it is desirable to have the lowest number of controls possible in a guitar. This contradiction between functionality and usability can be resolved with the help of an external programming device, which either has a wired or a wireless connection to the guitar. Guitars requiring power supply has the problem of changing and charging batteries. The main factors of usability regarding power supply are operating time, difficulty of changing batteries and the way and time needed to charge rechargeable batteries.

Prior Art

In general it can be said that guitars having traditional passive electronics lack versatility, active guitars lack usability, while digital guitars lack excellent sound quality.

Summarizing the above, guitars have to compromise between these criteria. In theory the ideal guitar is both fulfilling the criteria of excellent sound quality, versatility and usability Attempts were made to reach that goal.

U.S. Pat. No. 5,866,834 patent document describes a digitally controlled analog sound processing system, were an active guitar's analog components (switches, potentiometers) are digitally controlled. Control parameters are stored and can be assigned to the switches and potentiometers. A guitar built according to the document has many built-in controls, limited programming capability compared to the number of controls, and can be programmed only with the use of above mentioned controls. Furthermore programming parameters cannot be backed up, nor transferred to and loaded into another guitar.

U.S. Pat. No. 9,640,162 patent document discloses a digitally controlled pickup switching matrix, which can be programmed by an external device. This solution can only store and control pickup switching parameters, and only one guitar and one programming device can be connected.

The purpose of this invention is to provide a programmable signal processing system for stringed musical instruments, especially for electric guitars, which is able to provide excellent sound quality, versatility, programmability and ease of use at once.

The invention also provides a musical instrument setup system, where an external programming device is used for instrument setup, adjustments to the sound takes place real time and at least one set of setup parameters can be stored and loaded to an optional instrument.

The invention also provides a system, where nearly abundant sets of setup parameters can be created, safely stored and can be shared between instruments and users.

The invention provides a system, which is able to adopt to the physical configuration of different instruments and create setup parameters according to the configuration data of an individual instrument.

The invention provides a musical instrument setup system. Where the musical instrument has built-in analog signal processing and digital control unit with low operational power consumption, and much lower idle power consumption.

The object of the invention in the most general way can be reached according to the musical instrument setup and signal processing system and method provided herein.

In one embodiment of the invention

- a communication module with an individual identifier operably coupled to the control circuit, where the communication module provides a connection to the external programming device, which
- external programming device comprises of a communication module, a control circuit, a display, a user input interface and a storage,
- where the storage of the external programming device can store at least one individual instrument identifier, at least one musical instrument configuration file,
- the external programming device is capable of sending and receiving data in real time to/from a connected instrument, where
- data received from the external programming device can be stored in the instrument and used after disconnection.

In one embodiment of the invention the communication module is preferably a wireless communication module and the instrument configuration file contains the type of electroacoustic transducers of the musical instrument and other setting related data, and the type of controls and switches of the musical instrument and other setting related data.

In a further embodiment of the invention the external programming device can be switched to either programming or monitoring mode, and in monitoring mode the external device can display information to the user about the state of the controls and switches, the state of the control circuit and can load, store and display information from the musical instrument storage, including setup parameters.

In another preferred embodiment of the invention the external programming device connected to the instrument in programming mode can modify at least one setup parameter in the musical instrument in real time, store setup parameters in the external device storage, in a setup parameter file, mid send at least one part of the setup parameter file to the musical instrument storage.

In a further preferred embodiment of the invention controls and switches on the musical instrument are programmable controls and switches, where the function of the controls and switches can be determined by the external programming device and stored in a musical instrument configuration file and/or in a setup parameter file, and can be sent to the musical instrument storage.

In one embodiment of the invention the external programming device may be a personal computer, laptop, mobile device, that can be connected to a wireless local or remote network.

In alternative embodiment of the invention the external programming device can connect to a local or remote database server, where the setup parameters can be stored, searched and downloaded.

In another alternative embodiment of the invention, the database is a central database stored on a local or remote computer, and the user after a registration and identification process has access to the database through a server application.

Acorring to a further aspect of the invention, users can share setup parameters through the server application.

In one embodiment of the invention the electronic circuits in the musical instrument have a low consumption active operating mode and can be switched to an ultra low consumption idle mode.

In the method according to the invention

- a communication connection is established between the communication module of the external programming device and the uniquely identified communication module of the instrument, where
- at least one unique instrument identifier and instrument configuration file is stored in the external programming device, and upon connection data is being sent and received from/to the instrument in real time, where
- data received by the instrument are stored and used after disconnecting with the external programming device.

In the method according to the invention, as a communication module we are practically using a wireless communication module and in the instrument configuration file we are storing the type of electro-acoustic transducers of the instrument and other related data, and the type of controls and switches of the instrument and other related data.

In one favorable method related to the invention the external programming device can be switched to either programming or monitoring mode, where in monitoring mode with the external device we are downloading and storing the state of the controls and switches, the state of the control circuit and the data stored in the instrument storage, including guitar setup parameters, and we are displaying at least one part of the downloaded data on external device's screen in real time.

In another favorable method related to the invention using the external programming device connected to the instrument in programmable mode we are modifying at least one setup parameter in the instrument in real time, storing setup parameters in the external device storage, in a setup parameter file, and sending at least one part of the setup parameter file to the instrument storage.

In another favorable method related to the invention we are organizing sets of guitar setup parameters into collections, and we are transferring one of the collections into a connected instrument.

In another favorable method related to the invention controls and switches on the instrument are programmable controls and switches, where we are determining the function of the controls and switches with the external programming device and storing this information in an instrument configuration file or in a setup parameter, which we are sending to the instrument storage.

In a favorable method related to the invention we can practically connect the external programming device to a wireless local or remote server.

In another favorable method related to the invention we are connecting the external programming device to a local or remote database server where the setup parameters can be stored, searched and downloaded.

In another favorable method related to the invention, the central database is stored on a remote computer, and access is granted to the user after a registration and identification process to the database through a central (server) application.

In another favorable method related to the invention we are operating the central application in a way, that users are able to share their instrument setup parameters with each other.

The system and method related to the invention enables electric stringed musical instrument players, especially guitar players with

- the creation of unlimited numbers of instrument setup parameters,
- grouping the parameters in collections,
- real time data transfer between an instrument and/or external programming device connected to the instrument,
- sharing sets of setup parameters with other instruments and/or users, where other instruments and/or users can be remote instruments and/or users.

Figure 2:
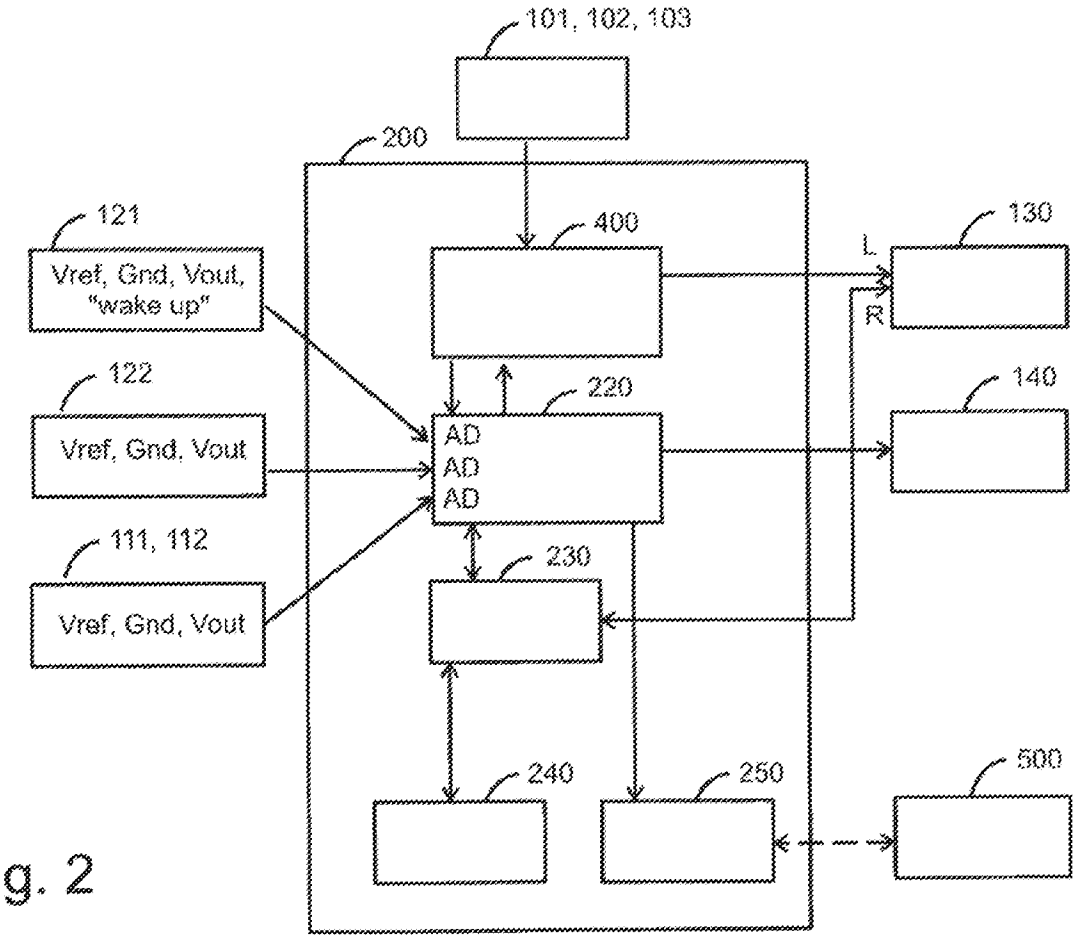
Figure 3A:
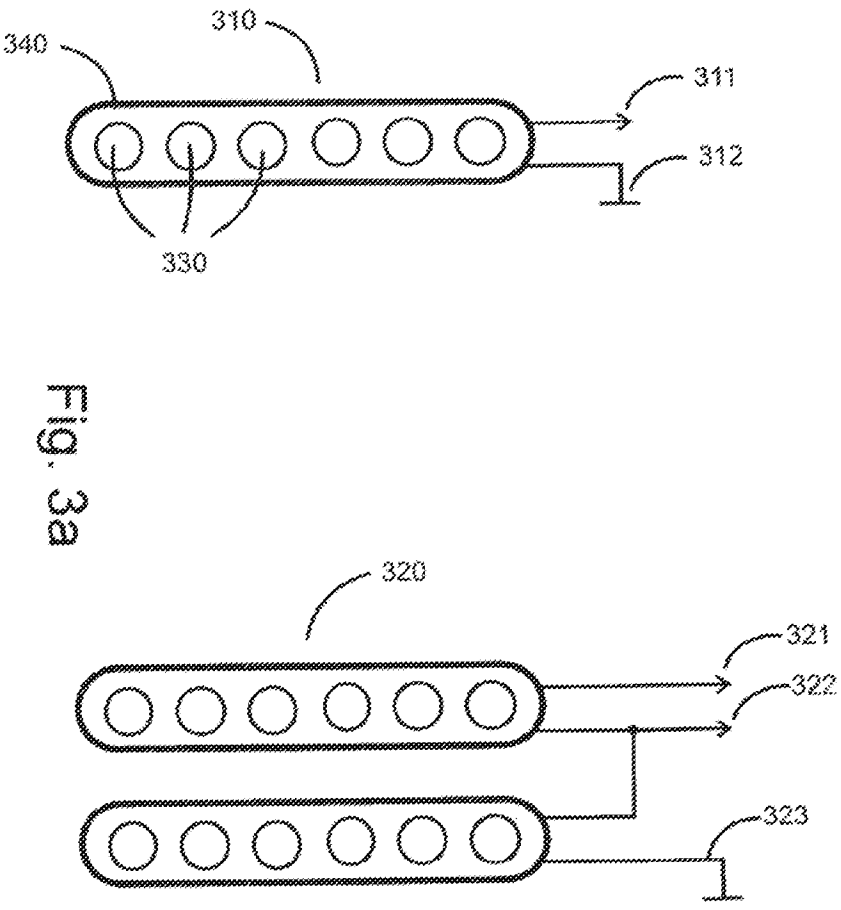
Figure 3B:
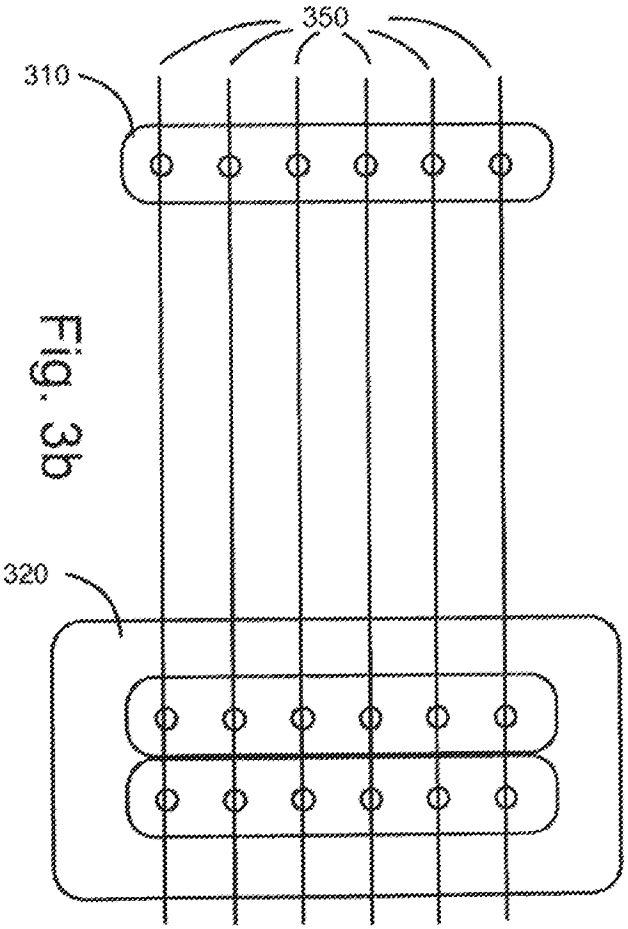
Figure 4:
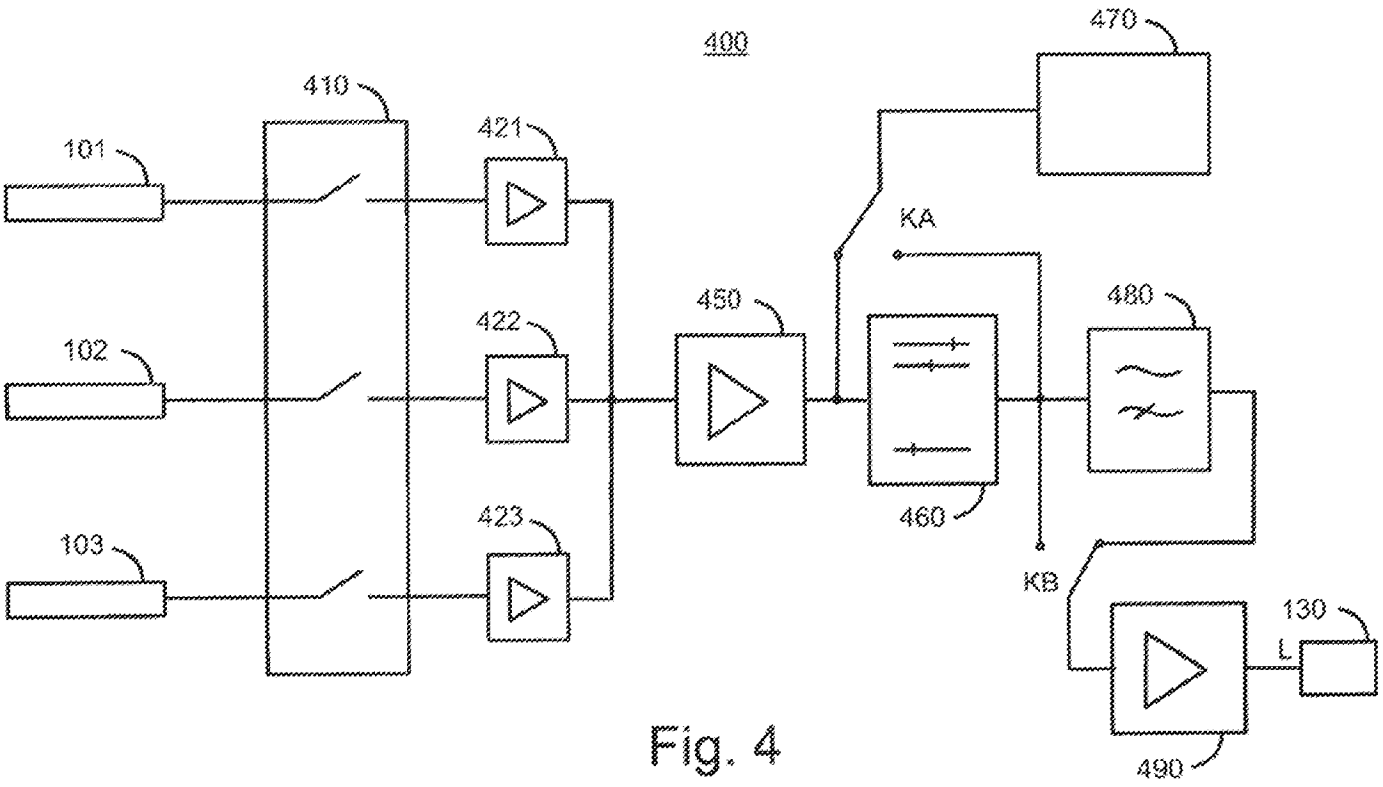
Figure 5:
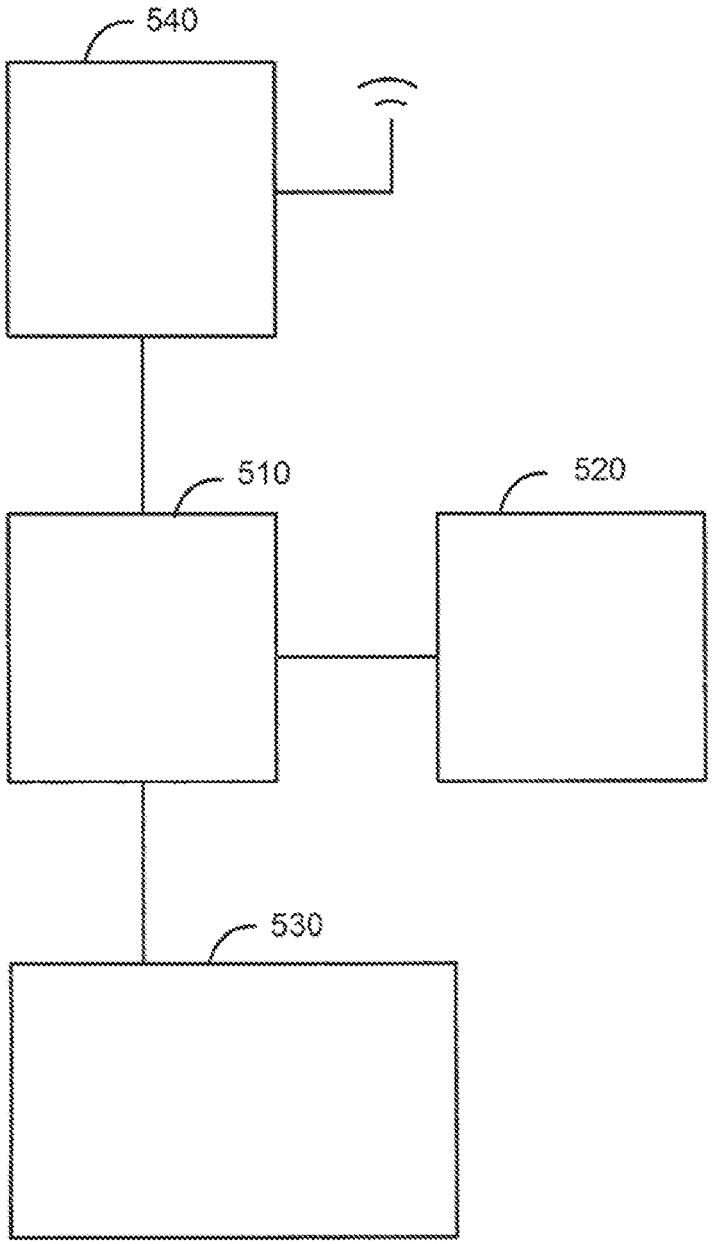

The invention is further described in detail according to the attached drawings of example embodiments, where FIG. 1 depicts a guitar and an external programming device in accordance with the invention FIG. 2 depicts the block diagram of the system in accordance with the invention FIGS. 3*a* 3*b* depict the schematic of pickups mounted on the instrument with one possible way wiring in accordance with the invention FIG. 4 depicts the simplified block diagram of the signal processing circuit in accordance with the invention FIG. 5 depicts the simplified block diagram of the external programming device in accordance with the invention FIGS. 6-19. depict the screens of the external programming device with a possible user interface design in accordance with the invention.

With reference to FIG. 1, a stringed musical instrument, in this illustrative embodiment an electric guitar 100, and an external programming device 500, in this illustrative embodiment a tablet or smart phone is shown in accordance with the guitar setup and signal processing system.

The electric guitar 100 includes electro acoustic transducers, in this illustrative embodiment electromagnetic pickups 101, 102, 103, continuously and discretely changeable setup switches, in this illustrative embodiment two potentiometers 111, 112, a main selector switch 121, and a secondary selector switch 122, an output jack socket 130, a LED indicator light 140 and an electronic module 200. The electronic module 200 is described in more detail in connection with FIG. 2.

In this illustrative embodiment FIG. 2 depicts block diagram of the connecting elements of the system, including the structure of the electronic module 200, which can be mounted in an instrument and 500 external programming device. In FIGS. 1 and 2 identical elements are indicated with the same reference numbers. The 280 electronic module, which can be integrated in a musical instrument, includes an analog signal processing circuit 400, a digital control circuit 220, which is connected to the analog signal processing circuit 400 where the digital control circuit 220 has a storage for storing a control program and control data. The electromagnetic pickups 101, 102, 103 are connected to the input of the analog signal processing circuit 400 and the output of the analog signal processing circuit 400 is connected to a jack socket 130 which is also mounted on the instrument. The continuously and discretely changeable setup switches, which in this illustrative embodiment are two potentiometers 111, 112, a main selector switch 121, and a secondary selector switch 122 are connected to the digital control circuit 220 together with a LED indicator light 140, a battery charging unit 230 and a communication module 250. An external programming device 500 is connected to the musical instrument electronics through the communication module 250. The communication module 250 is preferably a wireless communication module, such as a communication module with a WiFi or Bluetooth specification. A battery 240, preferably a Li-ion battery, is connected to the battery charging unit 230. The battery 240 is the main power supply for the musical instrument. High operation time (at least 15 hours) is achieved as a result of the high capacity battery and low power consumption of the electronic circuit. The digital control circuit 220 can operate in two different modes, normal operation mode and standby mode. In normal operation the electronic circuit has a relatively low current consumption, which decreases to a nearly negligible, approximately 8 micro Ampere level in standby mode. In standby mode the analog signal processing circuit 400, the communication module 250 and the battery charging unit 230 are switched off from the power supply and the control circuit consumes energy only to keep the data in its storage. Entering the standby mode can be achieved by switching the main selecting switch 121 to OFF position. Switching to EDIT position of the main selecting switch 121, the electric circuit "wakes up" and enters into normal operation mode. In accordance with the embodiment shown in FIG. 2, a stereo jack socket 130 is used, where the left contact point may be used as an output for the audio signal, the right contact point as the input for the input voltage of the battery charger. When the input voltage (e.g. 5V) of the battery charger is present on the right contact point of the jack socket 130, charging mode begins which also "wakes up" the electronic circuit and switches to normal operation mode. In this mode the control circuit 220 is monitoring the battery charging unit 230. The LED indicator light 140 is capable of showing whether the musical instrument is in OFF or EDIT mode, and in EDIT mode, whether it is in programing (connected) or standalone (disconnected) mode.

The control circuit 220 is preferably a low consumption microcontroller, which has a storage, at least one AD input, a reference voltage output, more than one control outputs (GPIO) and able to communicate with the analog signal processing circuit 400 and the communication module 250 via standard bus and standard protocol.

In an embodiment, two potentiometers 111, 112 are connected to the control circuit 220 through AD inputs. The two potentiometers are preferably linear potentiometers with three terminals, which may be reference voltage Vref, ground Gnd and voltage output Vout. The reference voltage Vref is connected to the reference voltage output of the control circuit 220. The voltage output Vout is connected to an AD input of the control circuit 220. Voltage measured on the voltage output Vont determines the state of the potentiometer.

The electronic module 200, which can be mounted in an instrument, includes the communication module 250, which has a unique identifier, and is preferably a Bluetooth module. The communications module 250 can establish a connection with the external programming device 500, which is preferably a smartphone or a tablet that is capable of running an Android, IOS or similar operating system. Communication module using the Bluetooth protocol can provide connection at distances typical in a recording studio, rehearsal room, stage or in a smaller concert hall. WiFi protocol can be used for greater distances, which can also provide connection to a local area network (LAN) or to a wide area network (WAN), like the Internet. The electronic module 200, which can be mounted in an instrument preferably has a communication module 250 with at least one of the above communication protocols, while the external programming device 500 preferably has a communication module with both communication protocols available.

According to its main functions, the control circuit 220 (microcontroller):

- provides power supply to the analog signal processing unit 400 with the regulation of a boost converter,
- communicates with the analog signal processing unit 400 using the I2C protocol,
- reads spectrum analyzer data from the analog signal processing unit 400,
- determines the state of the main selecting switch 121 with AD detection,
- determines the state of the secondary selecting switch 122 with AD detection,
- determines the state of the potentiometer 111 with AD detection,
- determines the state of the potentiometer 112 with AD detection,
- regulates power supply of the communication module 250,
- communicates with the communication module 250 using the UART protocol,
- regulates the battery charging unit 230,
- provides status information about the operation,
- monitors the battery level.

The 220 control circuit can charge the battery in each operation mode.

The control circuit 220 turns into programmable mode, when the main selecting switch 121 is in EDIT state. In programmable mode the control circuit 220 turns on the power supply of the communication module 250 and establishes a connection with it using the UART protocol. In this mode the external programming device 500 is able to establish a Bluetooth connection with the communication module 250, and thus with the control circuit 220. The LED indicator light 140 flashes at least once, preferably twice in a second to indicate that the communication module 250 is ready and waiting for the external programming device 500 to establish a connection with it. When the external programming device 500 has connected to the communication module 250, and the control circuit 220 is in programmable mode, the LED indicator light 140 flashes at a lower rate, preferably once in every 2 seconds.

In programmable mode the external programming device 500 is capable of changing parameters of the analog signal processing circuit 400, either one by one or in a set of parameters (PRESET). Tone can be refined by changing the parameters one by one, than the final set of parameters can be stored in a uniquely named PRESET in the external programming device 500. Using the external programming device 500, each uniquely named PRESET can be selected to determine the sound quality (tone) of the analog signal processing circuit 400.

Each 101, 102 potentiometer can be assigned to certain PRESET parameters (e.g. volume, pickup mixing rate), and this assignments can be stored in an individual PRESET.

When the communication module 250 and the external programming device 500 are not in connection, and the main selecting switch 121 is in a state A, B, C, D, E, F, G, H, I or J, the control circuit 220 is operating in standalone mode. In standalone mode according to the combination of the state of the main selecting switch 121 and the secondary selecting switch 122, PRESETS are loaded from a collection stored in the storage of the control circuit 220. In this mode the communication module 250 is in power off state. The loaded/selected PRESET is being sent to the analog signal processing circuit 400 through the I2C interface of the control circuit 220. As a result, the tone of the instrument changes. If one of the potentiometers 111 and 112 are assigned to a certain PRESET parameter, turning the potentiometer will change that parameter in real time, in standalone mode the LED indicator light 140 is turned off.

In monitoring mode the main selecting switch 121 is still in one of the above mentioned states A to J, but the external programming device 500 is in connection with the control circuit 220, through the communication module 250. In this mode the external programming device 500 is displaying the actually selected PRESET with ever parameter it has. (see FIG. 17.)

The main selecting switch 121 is preferably a twelve-state main switch, which can be for example built in a guitar to replace one of the potentiometers. The main switch 121 preferably has four terminals, which may be reference voltage Vref, ground Gnd, voltage output Vout and "wake-up" contact point. The reference voltage Vref is connected to the reference voltage output of the control circuit 220 and the voltage output Vout is connected to an AD input of the control circuit 220. Voltage measured on the voltage output Vout determines the state of the switch. The "wake-up" contact point is necessary to switch the control circuit 220 to normal operation mode.

The secondary selecting switch 122 is preferably a five-state secondary switch, which can be built in a guitar to replace the pickup selector switch. The secondary selecting switch 122 preferably has three terminals, which may be reference voltage Vref, ground Gnd and voltage output Vout. The reference voltage Vref is connected to the reference voltage output of the control circuit 220. The voltage output Vout is connected to an AD input of the control circuit 220. Voltage measured on the voltage output Vout determines the state of the switch.

FIG. 3 depicts the already presented pickups 101, 102, 103 in greater detail.

FIG. 3*a* depicts two kind of pickups and their electrical connections. FIG. 3*b* depicts the positions of the pickups on the instrument. FIG. 3*b* clearly shows that the pickups 310 and 320 are located under the strings 350. This illustrative embodiment presents electromagnetic pickups. Electromagnetic pickups convert the vibrations a the metal strings to electric signal. These pickups consist of one or more electrical coils 340 and in the coils there are one or more magnetic or ferromagnetic elements 330.

The pickup 310 is of a single-coil type, which has one coil and in the coil there are six magnetic or ferromagnetic elements according to the number of the strings. The coil has two wires 312 and 311; of which the wire 312 is connected to ground and the wire 311 is the actual pickup signal wire. The pickup 320 is a double coil pickup, which has two coils. The coils have one magnetic or ferromagnetic element under each string. The two coils have opposite winding directions, which greatly reduces environmental electromagnetic noise. The two coils of the pickup 320 have two wires for each. The wire 323 is connected to ground (humbucker ground), the wire 322 is the common wire of the two coils (split humbucker signal) and the wire 321 is the double coil signal wire (humbucker signal). This type of pickup can be operated in double coil (humbucker) mode, if the signal of the wire 321 is used, or it can be operated in single coil mode, if signal of the wire 322 is used.

FIG. 4 depicts the internal connections and main elements of the analog signal processing circuit 400. The outputs of the pickups 101, 102, 103 are connected to the inputs of the analog signal processing circuit 400. Pickup signals are lead through the controllable switch 410 to the preamplifier and mixing stain 421, 422, 423. After the preamplifier and mixing stage 421, 422, 423, the pickup signal is fed to the main amplifier 450, then to a multi band equalizer 460. The equalizer 460 has at least three or five bands, preferably seven bands. The analog signal processing circuit 400 preferably includes a spectrum analyzer 470 unit, which can either analyze the signal before or after the equalizer 460. After the equalizer 460 there is a switchable high pass fitter 480, which can either be switched on or off before the signal arrives to the output amplifier 490. The high pass filter 480 is preferably a second order "butterworth" type filter with at least four cutoff frequencies (e.g. 90 Hz, 135 Hz, 180 Hz, 225 Hz). The output amplifier 490 provides the output of the analog signal processing circuit 400, which is connected to one (e.g. the left) contact point of the stereo jack socket 130.

The analog signal processing circuit 400 is capable of selecting from the pickups 101, 102, 103, switching between single coil or humbucker mode when the instrument has humbucknig pickups, mixing the selected pickup signals, changing the tone of the musical instrument by increasing and decreasing the amplitude of certain frequencies (equalization), filtering out low frequencies and transferring spectrum analyzer data. It is practical to choose a analog signal processing circuit 400 with a multi-band, preferably seven-band equalizer where increasing and decreasing frequency levels are selectable in soft step mode. It is also advantageous to have a separate mute function in each amplifying stage. The parameters of the analog signal processing circuit 400 may be digitally controlled by the control circuit 220, practically according to the stored setup parameters of the control circuit 220. I2C protocol is preferably used for connecting the control circuit 220 to the analog signal processing circuit 400. Programmable parameters of the analog signal processing circuit 400 include pickup switching parameters, pickup mixing parameters, preamp gain parameter, equalizer parameters, high pass filter parameters, output level parameter and spectrum an parameters.

FIG. 5 depicts the block diagram of the external programming device 500. The external programming device 500 comprises a control circuit 510, a storage 520 connected to the control circuit 510, a display 530 and a communication module 540. In this exemplary embodiment the storage 520 is located outside the control circuit 510, but in other alternative embodiments the control circuit 510 can include at least one part of the storage 520. The display 530 is preferably a touch screen, which is capable of displaying information and can also be used as a user input interface.

The external programming device 500 can include other controls, such as switches and buttons. The communication module 540 has preferably access to more than one standard wireless or wired communication channels. Wireless communication channels may include Bluetooth and WiFi standards as well as others. Wired communication channels may be provided according to the USB or similar standards. In one illustrative embodiment of the invention the external programming device 500 is connected to a communication module of an electric stringed musical instrument using the Bluetooth standard. The communication modules in each musical instrument have a unique identifier, therefore the external programming device 500 can identify and select each musical instrument. The range of Bluetooth devices depending on performance rate can be 1 meter, 10 meters and even 100 meters. If higher range is desired WiFi standard can be used, which also provides the possibility of connecting to a local or remote network (LAN, WAN). The storage 520 of the external programming device 500 may be provided with a control program, musical instrument configuration files and musical instrument setup parameter files. Through the selected communication channel, data in the storage 520 of the external programming device 500 can be transferred to at least one musical instrument 100. Similarly, through the communication channel, data in musical instruments can be transferred to the storage 520 of the external programming device 500. As sets of instrument setup parameters (presets, preset collections) can be transferred in both directions, they can be evenly distributed or shared between musical instruments. Periodic data transfer from a musical instrument provides the possibility of real time periodic instrument monitoring.

As the communication module 540 of the external programming device 500 is able to establish a connection with a remote, or a local network (WAN, LAN), remote users can share instrument setup parameters with each other. Instrument setup parameters created by users can be stored in a database which may be located in a distant (server, cloud) computer. Users can access the database through a server application after a registration and authentication process.

An application running on the external programming device 500 can provide functions to the system, such as creating instrument configuration files, assigning unique instrument identifiers/names to instruments, creating and storing at least one set of setup parameters (PRESET) per instrument, connection to a selected instrument, data transfer from or to a selected instrument once or periodically, storing data transferred from an instrument and monitoring an instrument with displaying periodically transferred data. An illustrative control algorithm (application) is presented, and described in detail according to the screenshots of the external programming device 500.

Figure 6:
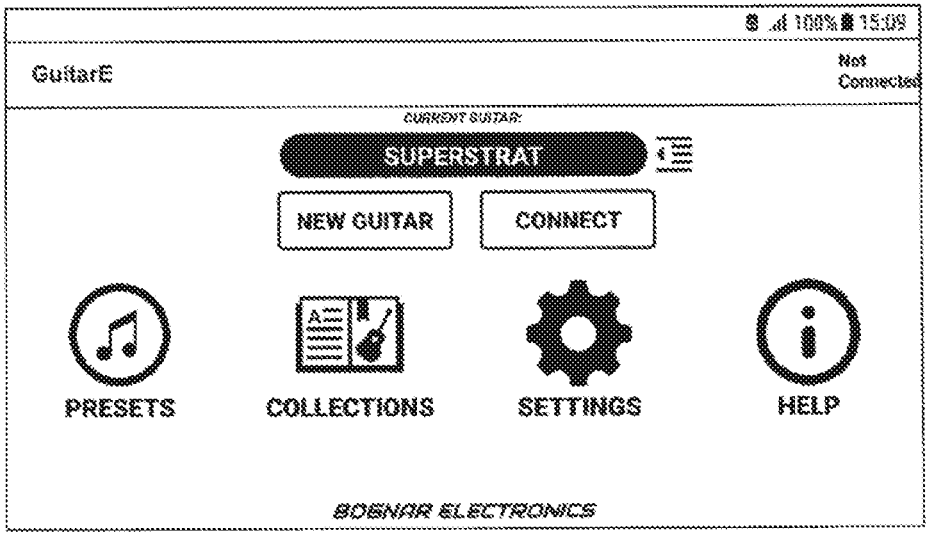
Figure 7:
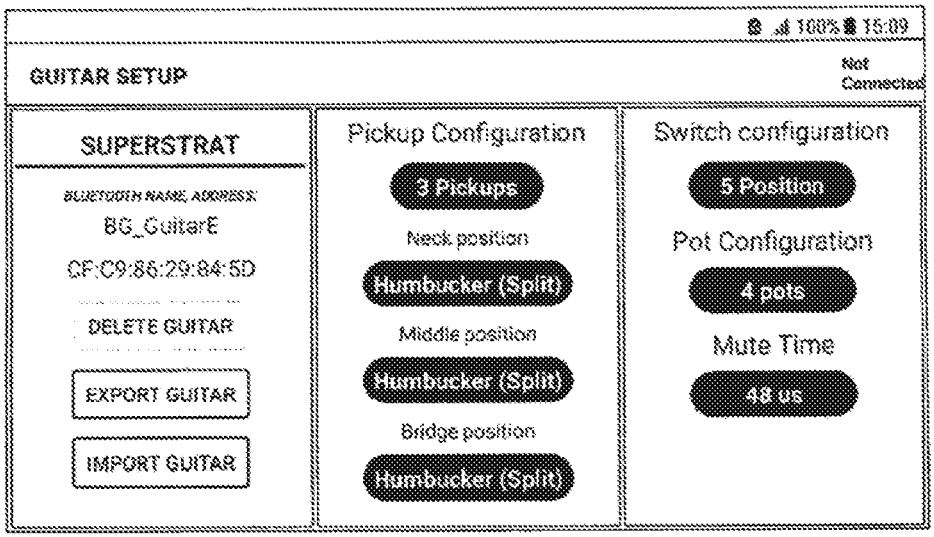

In FIG. 6 the main menu of the 500 external programming device is shown, which includes the name of the selected guitar, connection state (currently not connected), a button for new guitar creation (NEW GUITAR) and a button for starting a connection procedure with the selected guitar (CONNECT). By pressing the name of the current guitar and choosing from the popup guitar list selector, another guitar can be selected. "PRESETS" button brings up the presets screen (FIG. 12, 13.), "COLLECTIONS" button brings up preset collection screen (FIG. 14.), "SETTINGS" button brings up the settings screen (FIG. 8.) and "ABOUT" button brings up information about the application software.

The "NEW GUITAR" button (FIG. 6) brings up another variant of the "SETTINGS" screen (FIG. 7.), where it is possible to configure a new guitar (CREATE) or import a guitar from an external file (IMPORT). Guitar import will also import the collections and guitar setup parameters (PRESETS) belonging to the imported guitar.

Before pressing the "CREATE" button, providing a unique guitar name, a guitar specific Bluetooth address and configuration of the pickups, switch(es) and potentiometer(s) are needed. After creating a new guitar it is possible to connect to it and change the guitar setup parameters.

On this screen the number of selected pickups can be set to one, two or three. Type of the pickups, such as single coil, humbucker or "splittable" humbucker can also be configured for each pickup.

Figure 8:
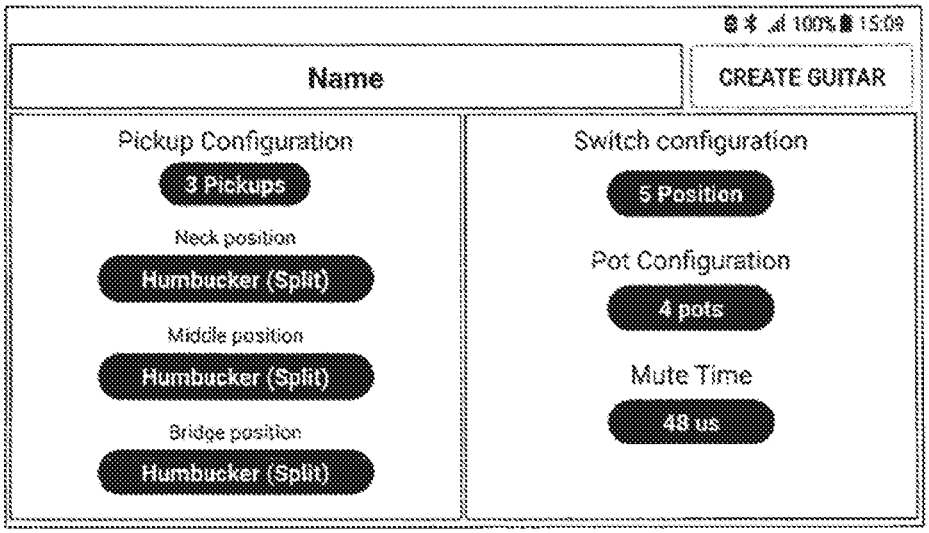

On the other "SETTINGS" screen, shown in FIG. 8, the user is able to delete, export or import the configuration data of an existing guitar. Deleting a guitar will delete all the collections and guitar setup parameter sets belonging to that guitar. Exporting a guitar will save guitar configuration data, collection data and guitar setup parameter data into a file, which can be imported any time. When performing these operations, it is not necessary to be in connection with a musical instrument instrument.

Figure 9:
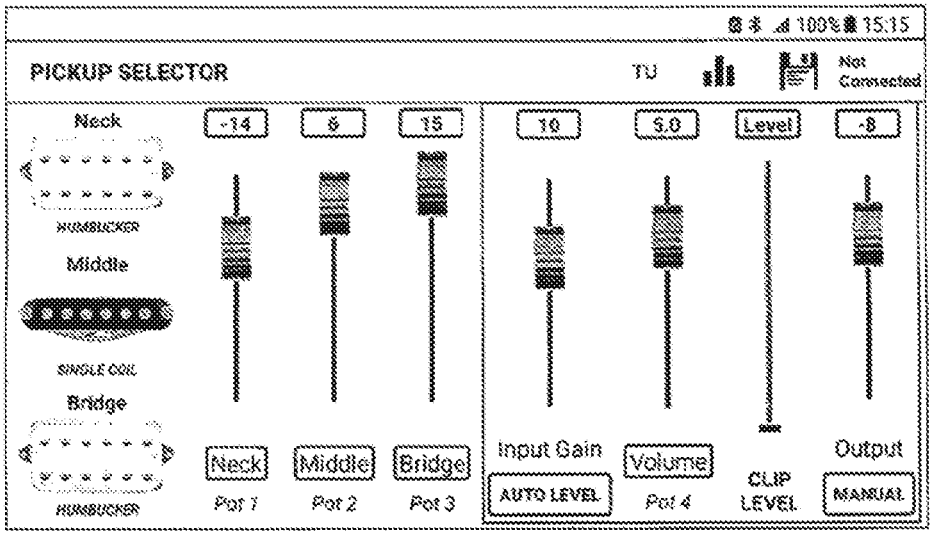
Figure 10:
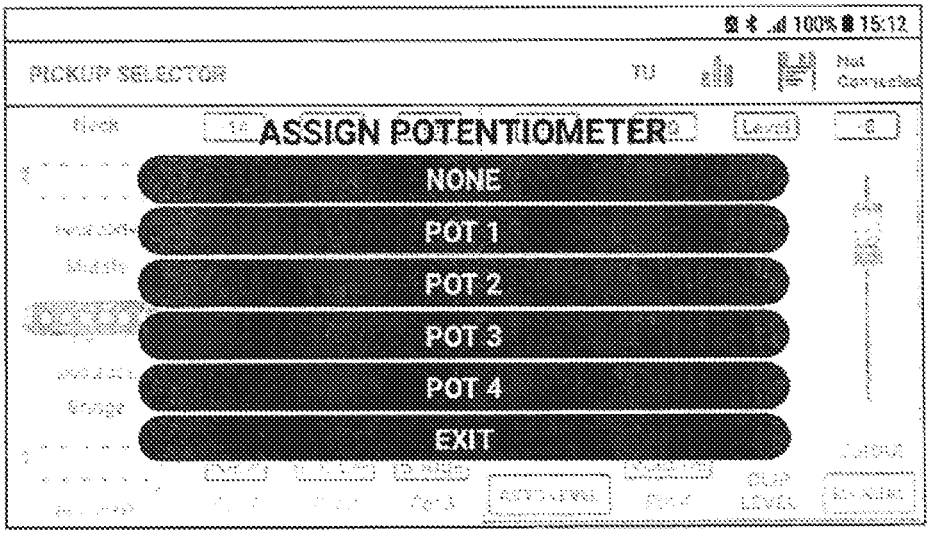

In the "PICKUP SELECTOR" screen, depicted in FIG. 9, to the user can change some of the guitar setup parameters. It is possible to bring up this screen by pressing the pickup icon either at the top of the "EQUALIZER" screen (FIG. 11.) or on the left side of the "PRESET EDIT" screen (FIG. 12.). On the left side of the screen the number and types of pickups can be seen according to the guitar configuration.

Pickup switching parameters determine how electromagnetic pickups are taking part in the creation of the electric signal. Electromagnetic pickups can work in the following states, depending on their type: single coil mode, humbucker mode, and split humbucker mode (only one coil of a dual-coil pickup is used). In each state the pickups can be on or off.

If a guitar configuration has split humbucker pickups, then pressing a pickup icon switches the selected pickup to single coil, or humbucker mode. The three faders next to the pickup icons are pickup mixing faders. With the help of these faders, each pickup's level can be adjusted in the range of +15 dB to −79 dB with 1 db resolution in a so called "soft-step" mode. The input gain fader controls preamplifier level, the volume fader controls main volume level which can be adjusted in the range of +32 dB to −80 dB with 0.5 dB solution. The output fader controls the output level of the instrument. Pressing the name of a fader which is bordered, brings up the "ASSIGN POTENTIOMETER" screen (FIG. 10.), where a potentiometer can be assigned to the selected fader. Potentiometer assignments can be seen under the names of each fader on FIG. 9. On the upper menu bar "TU" icon brings up the "TUNER" screen (FIG. 19.) and the save icon saves all modifications. When the application is connected to a musical instrument, all parameter adjustments will be transferred to the musical instrument, thus they will be audible in real time. Setup parameters can also be changed in disconnected mode, but the tuner and parameter sending towards the guitar will only work in connected mode.

Figure 11:
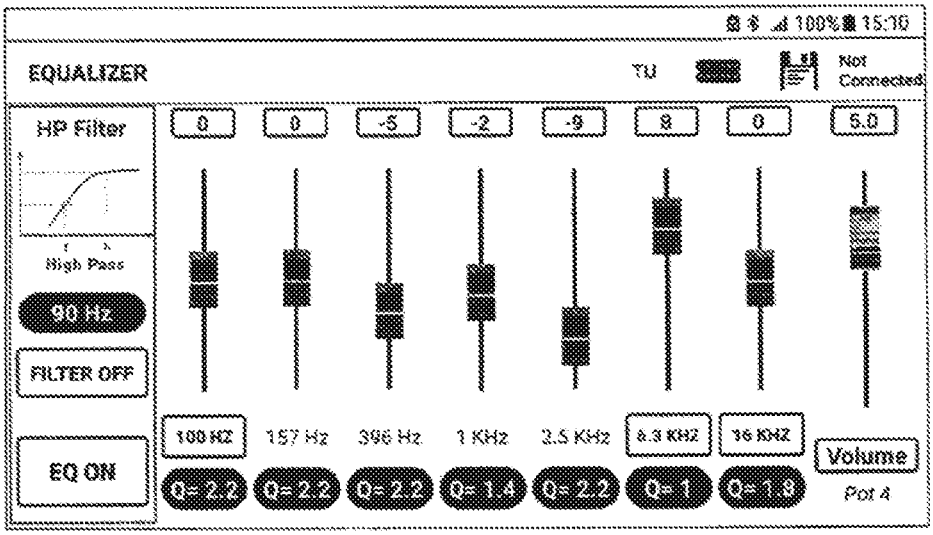
Figure 12:
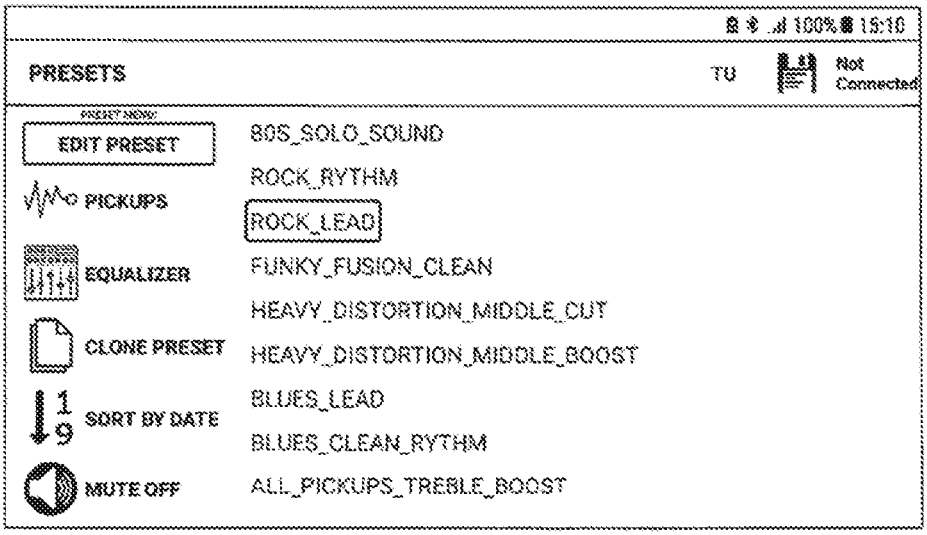

FIG. 11 depicts the "EQUALIZER" screen. On the left side of the screen there is a control panel for the high pass filter, with a FILTER ON/OFF button and a cutoff frequency selector. The high pass filter in one embodiment of the invention has four cutoff frequencies (90 Hz, 135 Hz, 180 Hz, 225 Hz), and can be used to completely filter out unwanted low frequencies from the equalized signal. Under the high pass filter there is an on/off switch for the equalizer.

The seven-band equalizer has a −15 to +15 dB range with 1 dB resolution, and four selectable quality factors for each band (Q=1; Q=1,4; Q=1,8; Q=2,2). The lowest and the two highest cutoff frequencies are selectable (62 or 100 Hz, 4 KHz or 6.3 Khz, 15 KHz or 16 KHz). On the right hand side of the screen there is the same volume fader known from the pickup selector screen. On the upper menu bar "TU" button brings up the "TUNER" screen (FIG. 19.), the save button saves all modifications and the pickup icon brings up the "PICKUP SELECTOR" screen. When the application is connected to an instrument all parameter adjustments will be transferred to the instrument, thus they will be audible in real time. Setup parameters can also be changed in disconnected mode, but the tuner and parameter sending towards the guitar will only work in connection mode.

Figure 13:
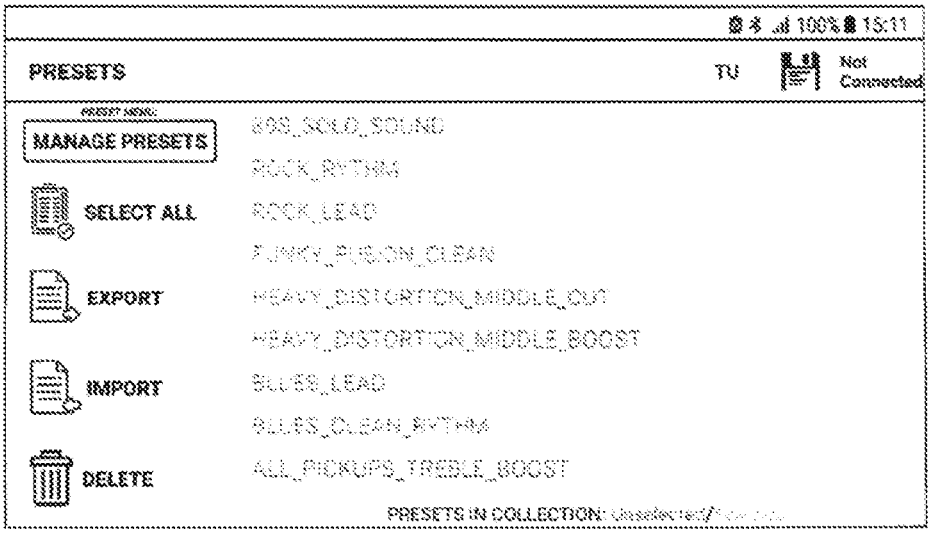

FIGS. 12 and 13 depict the "PRESETS" screens, which shows the sets of guitar setup parameters (PRESETS) the selected guitar has FIG. 12 depicts the editing screen of the presets, while FIG. 13 depicts the managing screen of the presets. Switching between the two screens is possible by pressing the EDIT/MANAGE toggle button.

On the editing screen (FIG. 12.) new presets can be created and preset parameters can be changed. In the middle of the screen there is a list containing the existing presets. The actually selected preset is bordered and the associated setup parameters are sent to the instrument. Changing preset is done by pressing the name of another preset. Upon preset change, the changed preset will be bordered and the associated setup data sent to the instrument. The PICKUPS button brings up the PICKUP SELECTOR screen (FIG. 9.), the EQUALIZER button brings up the EQUALIZER screen, and the CLONE PRESET button makes a copy of the selected preset data with a new name. Sorting the preset list is possible with the SORT BY DATE/SORT BY NAME button. By pressing the MUTE ON/MUTE OFF toggle button, the sound of the instrument can be muted. On the upper menu bar "TU" button brings up the "TUNER" screen (FIG. 19.) and the save button saves all modifications made to the selected preset.

On the MANAGE PRESETS (FIG. 13.) screen it is possible to export, import and delete presets. In the middle of the screen there is the same preset list as described above, with the exception that multiple preset selection is possible, and preset selection will not change the setup parameters of the instrument. At least one selected preset can be exported into a file, which file can later be imported to the same, or to another instruments. Selecting all presets is possible with the SELECT ALL button on the top left side of the screen. In the preset list, presets which are added to a preset collection are (FIG. 14.) marked with a different color. A preset be added to multiple collections.

Figure 14:
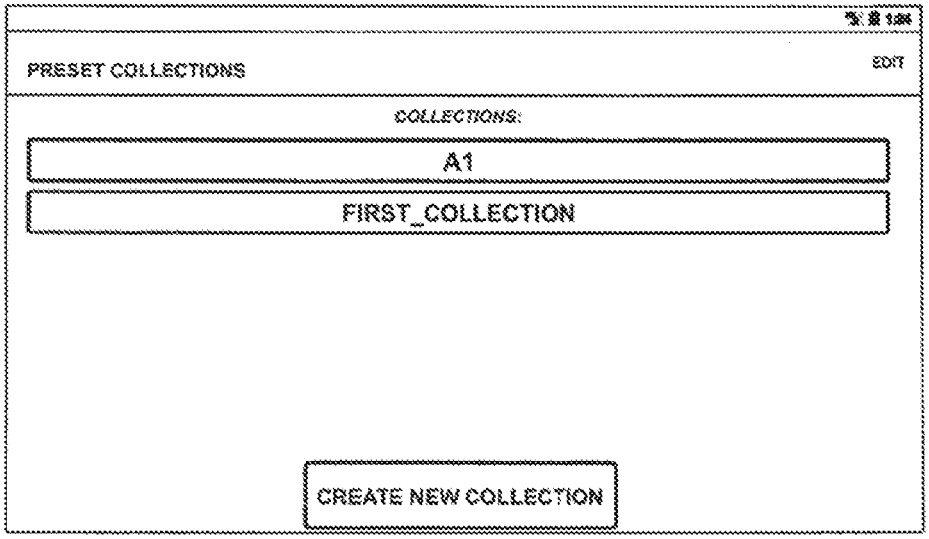

Pressing the Collections button in the main menu (FIG. 6.) brings up the PRESET COLLECTIONS screen depicted in FIG. 14. With a unique name individually identified presets created on the external programming device 500 can be added to a preset collection. A preset collection is a list containing all possible combinations of the state of the selecting switches 121, 122. A preset can be assigned to at least one position of the list.

Figure 15:
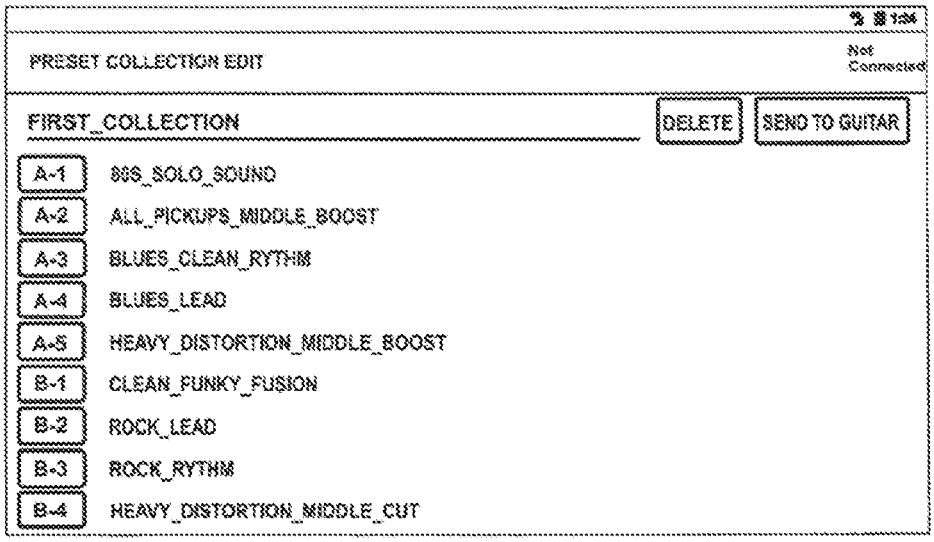

The maximum size of the collection list is determined by the number of positions the selecting switches can have. According to the presented exemplary embodiment of the invention, the main selecting switch has ten positions and the secondary selecting switch has five positions capable of preset assignment which means that a collection list can contain up to fifty items. Indicating the positions of the main selecting switch with A, B, C, D, E, F, G, H, I, J and the positions of the secondary selecting switch with 1, 2, 3, 4, 5, the switch combinations are A1, A2 . . . J4 and J5. Indicating presets with P1, P2 . . . Pn, the elements of a C1 collection can be described by a set C1={P1, P2 . . . Pna}. Presets can be assigned to a collection list according to the following example A1=P1; A2=P2; A3=P3; . . . J5=P50. FIG. 14 depicts a list of the previously created collections, which can be edited by pressing their names on the PRESET COLLECTION EDIT screen (FIG. 15.) Initially, the list is empty and with pressing the CREATE NEW COLLECTION button a new collection can be generated. To create a new collection, a unique name has to be provided in order to proceed to the PRESET COLLECTION EDIT screen. Presets and collections always belong to an individual instrument, e.g. guitar, but they can be exported, then imported to other instruments.

A collection can be edited, deleted and sent to an instrument on the PRESET COLLECTION EDIT screen depicted in FIG. 15. On the top left side of the screen there is the name of the collection. Next to it the DELETE and SEND TO GUITAR buttons are located. Pressing the delete button will delete the actual collection and brings back the PRESET COLLECTIONS screen (FIG. 14.). When the selected instrument is connected to the device, (FIG. 6. CONNECT) pressing the SEND TO GUITAR button sends the collection to the guitar and stores it in the storage of the control circuit. On the left hand side of the screen there are the switch combinations, A1 . . . J5, next to them the names of the assigned presets are visible. Switch combinations without a preset assigned are indicated with a dashed line. Editing a collection is done by pressing a dashed line or a preset name in the list, which brings up the PRESETS screen (FIG. 12.). On the presets screen, a double tap on a preset name brings back the collection edit screen and assigns the selected preset to the switch position.

Figure 16:
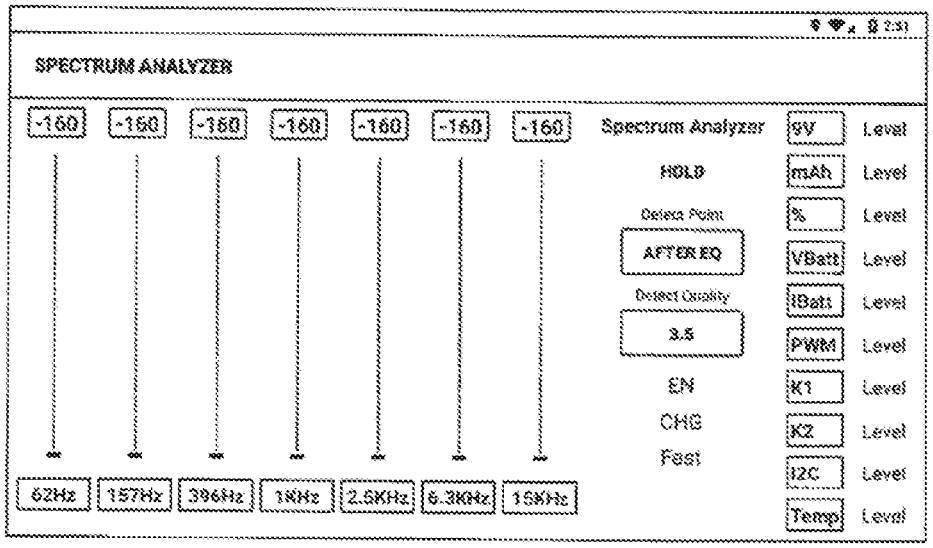

FIG. 16 depicts a screen which consist of the display of the spectrum analyzer, system specific status information and a few selectable spectrum analyzer parameters. System specific information and spectrum analyzer data are only present, if the application is connected to a musical instrument. As mentioned before, the analog signal processing circuit 400 comprises a spectrum analyzer unit 470 (FIG. 4), which provide's signal level information in certain frequency bands. Number of the frequency bands are preferably the same as the number of equalizer bands. Similarly to the equalizer, the spectrum analyzer has band filters in each frequency band, and in this illustrative embodiment the quality of the filters can be either set to Q=1,8 or Q=3,5. According to the schematic presentation in FIG. 4, the detection point of the spectrum analyzer can be switched to the equalized signal and to the signal before equalization.

On the SPECTRUM ANALYZER screen (FIG. 16.) the spectrum of the instrument's sound can be displayed in real time, along with other information. The spectrum analyzer can be switched on and off with the SA ON/SA OFF toggle button. Detect point of the spectrum analyzer can be switched to the signal before or after the equalizer by pressing the BEFORE EQ/AFTER EQ button. Quality factor of the spectrum analyzer filters can be changed in the DETECT QUALITY selector to either to Q=1.8 or to Q=3.5. Under the detect quality selector are battery charging information visible. On the right side of the screen, there is status information about the instrument's control circuit:

9V—Voltage of the audio signal processing circuit (this illustrative embodiment runs on 9V), which is generated from the 4V of the Li-ion battery.

mAh—Battery capacity in mAh.

%—Battery capacity in percentage.

Vbatt—Battery voltage.

Ibatt—Battery charging current.

PWM—Duty cycle of the boost converter used for producing 9 Volts.

K1—Position of the main selecting switch (OFF, EDIT, A, B, C, D, E, F, G, H, I, J)

K2—Position of the secondary selecting switch (1, 2, 3, 4, 5)

I2C—Number of the I2C communications.

Temp—Temperature of the instrument's control circuit.

Figure 17:
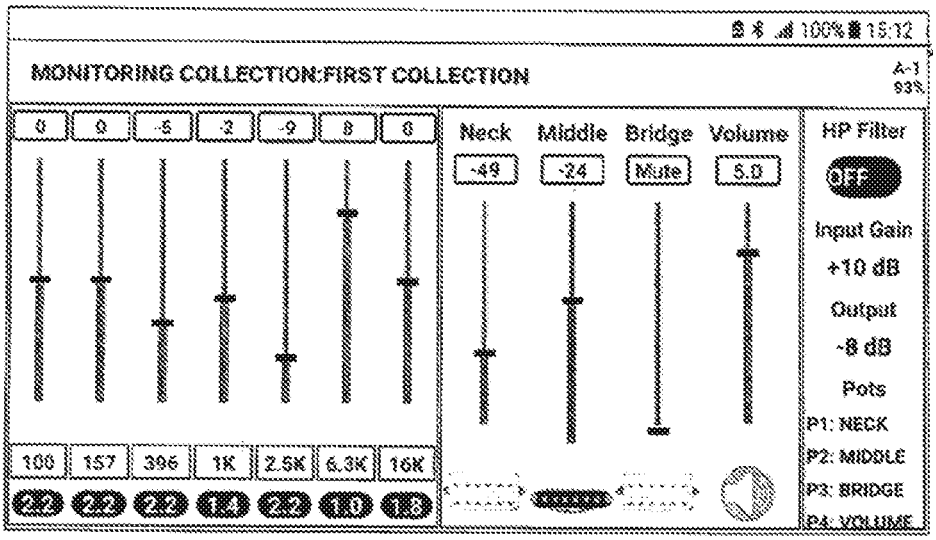

FIG. 17. illustrates the MONITORING screen, which is displayed when the external programming device is connected to the instrument and the main selecting switch is switched from EDIT to the A-J positions. The monitoring screen displays the preset parameters of the collection which is in the instrument's storage. The switch position of the instrument's switches are displayed at the right corner of the screen (A-1), and under it all the parameters of the assignee preset can be seen. On the left side of the screen are the parameters of the equalizer, next to it are the number and types of pickups, pickup mixing levels, volume level, mute state, and on the right are the cutoff frequency of the high pass filter, input gain level, output level and potentiometer assignments.

Figure 18:
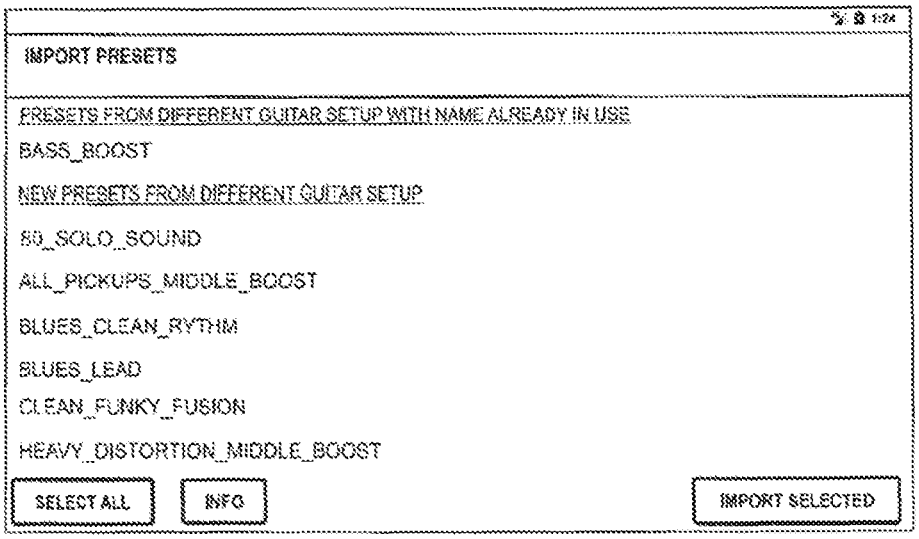

FIG. 18 shows the PRESET IMPORT screen.

Pressing the IMPORT button under the MANAGE PRESETS screen (FIG. 13.) a preset export file can be chosen containing one or more presets. Presets in the export file are compared to the existing preset list, and sorted on the screen according to the following aspects: presets with a name already in use, presets with same setup parameter values, presets with same name and same setup parameter values and presets coming from a different instrument setup. From the list, preset can be selected or unselected for import. Presets from different instrument setups are imported according to the current instrument setup parameters, and different parameter values, like pickup switching and mixing parameters, potentiometer assignments are not imported. Equalizer and signal level parameters are imported regardless of the instrument setup.

Figure 19:
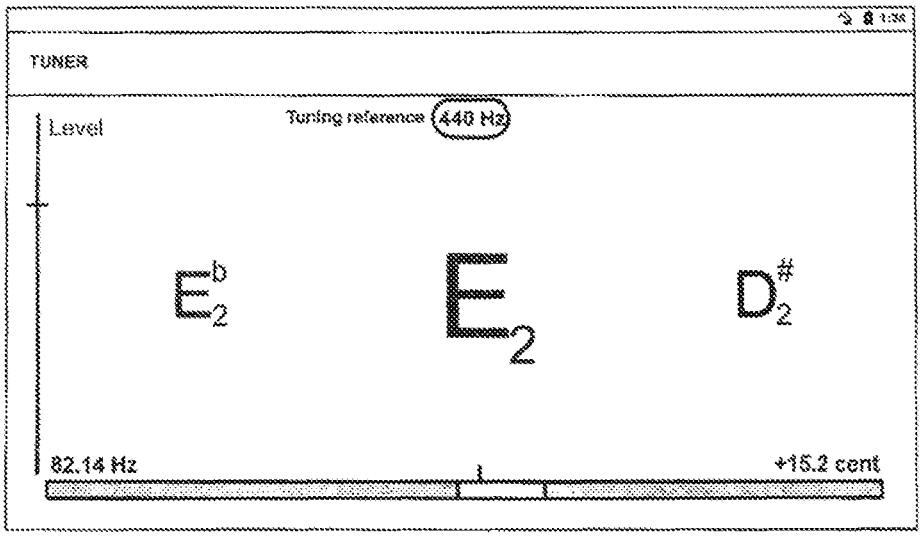

FIG. 19 shows the TUNER screen, with an instrument tuner function. On the screen there can be seen the frequency of the actual sound (82.14 Hz), the nearest musical note to the measured frequency (E2) and the difference between the measured frequency and the frequency of the musical note in cents (+15.2 cent). The accuracy of the tuning can also be monitored visually with the help of a tuning bar at the bottom of the screen. The level of the signal under tuning is shown on the left side of the screen. On the top of the screen there is a selector for choosing a reference timing frequency. Frequency of the sound is measured by the control circuit 220, which is transferred to the external programming device 500 through the communication module 250. (FIG. 2.)

The invention claimed is:

1. A programmable signal processing and instrument setup system for stringed musical instruments comprising:

arranged on the musical instrument (100)

a programmable analog signal processing circuit (400) for receiving an analog input sound signal and generating an analog output sound signal based on sound parameter settings in order to determine or change a sound quality of the musical instrument by selectively selecting at least one analog input sound source and equalizing a sound signal of the selected at least one analog input sound source and filtering the sound signal of the selected at least one analog input sound source and analyzing the sound signal of the selected at least one analog input sound source for selectively visualization and monitoring purposes;

a control circuit (220) connected to the analog signal processing circuit (400), and a storage unit connected to the control circuit (220), electro acoustic transducers (310, 320) being connected to the analog signal processing circuit (400) through controllable switches, and setting means (111, 112, 121, 122) being connected to the control circuit (220) for continuous or discrete setting of parameters of the musical instrument (100), wherein the storage unit of the control circuit (220) is configured for storing at least one set of setup parameters for the musical instrument, wherein a communication module (250) with an individual identification information is connected to the control circuit (220) for enabling communication with an external programming device (500), the external programming device (500) comprising a communication module, a control circuit, a display, data input means, and storage means, and the storage means of the external programming device (500) being configured for storing an individual identification information of at least one musical instrument, in association with the musical instrument in at least one configuration file, and the external programming device (500) further being configured for receiving data from a selected musical instrument (100), when connected, and sending data to a selected musical instrument (100), when connected, wherein the data sent to the musical instrument (100) can be stored in the musical instrument and can be used after the external programming device (500) is disconnected.

2. The system of claim 1, wherein the communication module is a wireless communication module, and in the configuration file of the musical instrument a type and other parameter settings of the electro acoustic transducers (310, 320) and a type and other parameter settings of the setting elements (111, 112, 121, 122) are included.

3. The system of claim 1, wherein the external programming device (500) is further configured for being switched to a programming mode or a monitoring mode upon user selection, when connected to a selected musical instrument, wherein the external programming device (500) in the monitoring mode is configured for receiving, storing, and displaying on the external programming device (500) in real time at least a part of status information of the setting means (111, 112, 121, 122), the control circuit (220), and the data stored within and received from the musical instrument or at least one set of the parameter settings received from the musical instrument.

4. The system of claim 1, wherein the external programming device (500) when switched to the programming mode is further configured to change in real time at least one setting parameter of a connected musical instrument (100) and to store the setting parameters of the musical instrument in the storage of the programming device (500) in a file comprising at least one set of parameter settings and to load the file comprising at least one set of parameter settings into a selected connected musical instrument (100).

5. The system of claim 1, wherein the setting means (111, 112, 121, 122) arranged on the musical instrument (100) are provided with programmable functions, wherein a function of the setting means can be determined with the external programming device (500) and the information relating to the function can be stored in a musical instrument configuration file and/or a musical instrument parameter settings file and transferred to a connected and selected musical instrument (100).

6. The system of claim 1, wherein the external programming device (500) may be selected from the group comprising a desktop computer, a laptop computer, a mobile computing device, or a mobile phone, being connectable to a local and/or a wide area network.

7. The system of claim 6, wherein the external programming device (500) is connectable through a local or wide area network to a database for storing, retrieving, and downloading sets of musical instrument parameter settings.

8. The system of claim 7, wherein the database is stored on a distant server and a user of the musical instrument or the external programming device (500) has access to the database after registration and authentication through a central server application.

9. The system of claim 8, wherein users, through the central application, can share the musical instrument parameter setting sets with each other.

10. The system of claim 1, wherein a power supply of electronic components arranged in the musical instrument can be switched to an active operation mode and a very low consumption idle mode.

11. A method for programming and operating a signal processing and instrument setup system for stringed musical instruments with the system comprising:

arranged on the musical instrument (100), a programmable analog signal processing circuit (400) for receiving an analog input sound signal and generating an analog output sound signal based on sound parameter settings in order to determine or change a sound quality of the musical instrument by selectively selecting at least one analog input sound source and equalizing a sound signal of the selected at least one analog input sound source and filtering the sound signal of the selected at least one analog input sound source and analyzing the sound signal of the selected at least one analog input sound source for selectively visualization and monitoring purposes;

a control circuit (220) connected to the analog signal processing circuit (400), and a storage unit connected to the control circuit (220), electro acoustic transducers (310, 320) being connected to the analog signal processing circuit (400) through controllable switches, and setting means (111, 112, 121, 122) being connected to the control circuit (220) for continuous or discrete setting of parameters of the musical instrument (100), the method comprising the steps of storing at least one set of setting parameters for the musical instrument in the storage of the control circuit (220), wherein the method further comprises the steps of providing a communication link between a communication module (250) with an individual identification of the musical instrument and a communication module of an external programming device (500), in the external programming device (500) storing an individual identification information of at least one musical instrument, in association with the musical instrument in at least one configuration file, and receiving data from a selected musical instrument (100), when connected, and sending data to a selected musical instrument (100), when connected, and storing the data sent to the musical instrument (100), in the musical instrument and using the stored data after the external programming device (500) is disconnected.

12. The method of claim 11, further comprising using a wireless communication module as communication module, and storing in the configuration file of the musical instrument a type and other parameter settings of the electro acoustic transducers (310, 320) and a type and other parameter settings of the setting elements (111, 112, 121, 122) are included.

13. The method of claim 11, further comprising the step of switching the external programming device (500) to a programming mode or a monitoring mode upon user selection, when connected to a selected musical instrument, wherein in the monitoring mode reading, storing and displaying on the external programming device (500) in real time at least a part of status information of the setting means (111, 112, 121, 122), the control circuit (220) and the data stored within and read from the musical instrument or at least one set of the parameter settings read from the musical instrument.

14. The method of claim 11, wherein if the external programming device (500) is switched to the programming mode, the method further comprises the step of changing in real time at least one setting parameter of a connected musical instrument (100) and storing the setting parameters of the musical instrument in the storage of the programming device (500) in a file comprising at least one setting parameter set and loading the file comprising at least one setting parameter set into a selected connected musical instrument (100).

15. The method of claim 14, further comprising setting up a collection of the sets of musical instrument parameter settings in the storage of the external programming device (500) and loading a selected collection to a connected and selected musical instrument (100).

16. The method of claim 11, wherein the setting means (111, 112, 121, 122) arranged on the musical instrument are provided with programmable functions, and the functions are determined with the external programming device (500) and the functions are stored in a musical instrument configuration file or a musical instrument parameter setting file, and can be loaded into a connected and selected musical instrument (100).

17. The method of claim 11, wherein the external programming device (500) is connected to a local and/or wide area network.

18. The method of claim 17, wherein the external programming device (500) is connected through a local and/or wide area network to a database for storing, retrieving, and downloading the sets of musical instrument parameter settings to the external programming device (500).

19. The method of claim 18, wherein the database is stored on a distant server and providing access for a user of the musical instrument or the external programming device (500) to the database after registration and authentication through a server application.

20. The method of claim 19, further comprising providing for users, through the server application, to share the sets of musical instrument parameter settings with each other.

21. A programmable signal processing and instrument setup system for stringed musical instruments comprising:

arranged on the musical instrument (100)

a programmable analog signal processing circuit (400) for receiving an analog input sound signal and generating an analog output sound signal based on sound parameter settings in order to determine or change a sound quality of the musical instrument by selectively selecting at least one analog input sound source and equalizing a sound signal of the selected at least one analog input sound source and filtering the sound signal of the selected at least one analog input sound source and analyzing the sound signal of the selected at least one analog input sound source for selectively visualization and monitoring purposes, a control circuit (220) connected to the analog signal processing circuit (400), and a storage unit connected to the control circuit (220), electro acoustic transducers (310, 320) being connected to the analog signal processing circuit (400) through controllable switches, and setting means (111, 112, 121, 122) being connected to the control circuit (220) for continuous or discrete setting of parameters of the musical instrument (100), wherein the storage unit of the control circuit (220) is configured for storing at least one set of setup parameters for the musical instrument, wherein a communication module (250) with an individual identification information is connected to the control circuit (220) for enabling communication with an external programming device (500), the external programming device (500) comprising a communication module, a control circuit, a display, data input means, and storage means, and the storage means of the external programming device (500) being configured for storing an individual identification information of at least one musical instrument, in association with the musical instrument in at least one configuration file, and the external programming device (500) further being configured for being switched selectively into a monitoring mode for receiving data from a selected musical instrument (100), when connected, and into a programming mode for sending data to a selected musical instrument (100), when connected, wherein the data sent to the musical instrument (100) can be stored in the musical instrument and can be used after the external programming device (500) is disconnected.

22. A method for programming and operating a signal processing and instrument setup system for stringed musical instruments with the system comprising:

arranged on the musical instrument (100), a programmable analog signal processing circuit (400) for receiving an analog input sound signal and generating an analog output sound signal based on sound parameter settings in order to determine or change a sound quality of the musical instrument by selectively selecting at least one analog input sound source and equalizing a sound signal of the selected at least one analog input sound source and filtering the sound signal of the selected at least one analog input sound source and analyzing the sound signal of the selected at least one analog input sound source for selectively visualization and monitoring purposes, a control circuit (220) connected to the analog signal processing circuit (400), and a storage unit connected to the control circuit (220), electro acoustic transducers (310, 320) being connected to the analog signal processing circuit (400) through controllable switches, and setting means (111, 112, 121, 122) being connected to the control circuit (220) for continuous or discrete setting of parameters of the musical instrument (100), the method comprising the steps of storing at least one set of setting parameters for the musical instrument in the storage of the control circuit (220), wherein the method further comprises the steps of providing a communication link between a communication module (250) with an individual identification of the musical instrument and a communication module of an external programming device (500), in the external programming device (500) storing an individual identification information of at least one musical instrument, in association with the musical instrument in at least one configuration file, and the external programming device (500) further being configured for being switched selectively into a monitoring mode for receiving data from a selected musical instrument (100), when connected, and into a programming mode for sending data to a selected musical instrument (100), when connected, and storing the data sent to the musical instrument (100), in the musical instrument and using the stored data after the external programming device (500) is disconnected.

23. A programmable signal processing and instrument setup system for stringed musical instruments comprising:

arranged on the musical instrument (100)

a programmable analog signal processing circuit (400) with a control circuit (220) connected to the analog signal processing circuit (400), and a storage unit connected to the control circuit (220), electro acoustic transducers (310, 320) being connected to the analog signal processing circuit (400) through controllable switches, and setting means (111, 112, 121, 122) being connected to the control circuit (220) for continuous or discrete setting of parameters of the musical instrument (100), wherein the storage unit of the control circuit (220) is configured for storing at least one set of setup parameters for the musical instrument, wherein a communication module (250) with an individual identification information is connected to the control circuit (220) for enabling communication with an external programming device (500), the external programming device (500) comprising a communication module, a control circuit, a display, data input means, and storage means, and the storage means of the external programming device (500) being configured for storing an individual identification information of at least one musical instrument, in association with the musical instrument in at least one configuration file, and the external programming device (500) further being configured for receiving data from a selected musical instrument (100), when connected, and sending data to a selected musical instrument (100), when connected, wherein the data sent to the musical instrument (100) can be stored in the musical instrument and can be used after the external programming device (500) is disconnected, and wherein the setting means (111, 112, 121, 122) arranged on the musical instrument (100) are provided with programmable functions, wherein a function of the setting means can be determined with the external programming device (500) and the information relating to the function can be stored in a musical instrument configuration file and/or a musical instrument parameter settings file and transferred to a connected and selected musical instrument (100).

24. A method for programming and operating a signal processing and instrument setup system for stringed musical instruments with the system comprising:

arranged on the musical instrument (100), a programmable analog signal processing circuit (400) with a control circuit (220) connected to the analog signal processing circuit (400), and a storage unit connected to the control circuit (220), electro acoustic transducers (310, 320) being connected to the analog signal processing circuit (400) through controllable switches, and setting means (111, 112, 121, 122) being connected to the control circuit (220) for continuous or discrete setting of parameters of the musical instrument (100), the method comprising the steps of storing at least one set of setting parameters for the musical instrument in the storage of the control circuit (220), wherein the method further comprises the steps of providing a communication link between a communication module (250) with an individual identification of the musical instrument and a communication module of an external programming device (500), in the external programming device (500) storing an individual identification information of at least one musical instrument, in association with the musical instrument in at least one configuration file, and receiving data from a selected musical instrument (100), when connected, and sending data to a selected musical instrument (100), when connected, and storing the data sent to the musical instrument (100), in the musical instrument and using the stored data after the external programming device (500) is disconnected, wherein the setting means (111, 112, 121, 122) arranged on the musical instrument are provided with programmable functions, and the functions are determined with the external programming device (500) and the functions are stored in a musical instrument configuration file or a musical instrument parameter setting file, and can be loaded into a connected and selected musical instrument (100).

* * * * *